US006777650B1

(12) United States Patent
Hamel

(10) Patent No.: US 6,777,650 B1
(45) Date of Patent: Aug. 17, 2004

(54) IGNITER SHIELDS

(75) Inventor: Scott M. Hamel, Wilton, NH (US)

(73) Assignee: Saint-Gobtain Industrial Ceramics, Inc., Worcester, MA (US)

( * ) Notice: Subject to any disclaimer, the term of this patent is extended or adjusted under 35 U.S.C. 154(b) by 401 days.

(21) Appl. No.: 09/498,309

(22) Filed: Feb. 4, 2000

(51) Int. Cl.[7] ..... F23Q 7/00
(52) U.S. Cl. ..... 219/267; 219/270
(58) Field of Search ..... 219/270, 267, 219/260; 431/263; 361/264–266; D7/416; 313/143

(56) References Cited

U.S. PATENT DOCUMENTS

| | | | | | |
|---|---|---|---|---|---|
| 2,675,068 | A | * | 4/1954 | Gollus et al. | 431/349 |
| 2,834,904 | A | * | 5/1958 | Dickey | 313/143 |
| 2,850,084 | A | * | 9/1958 | Kunzler | 431/263 |
| 3,301,606 | A | * | 1/1967 | Bruno | 406/92 |
| 3,823,345 | A | * | 7/1974 | Mitts et al. | 219/267 |
| 3,875,477 | A | | 4/1975 | Fredriksson et al. | |
| 4,029,936 | A | * | 6/1977 | Schweitzer | 219/267 |
| 4,905,660 | A | | 3/1990 | Leduc | |
| 4,954,743 | A | * | 9/1990 | Suzuki et al. | 313/120 |
| 4,972,811 | A | * | 11/1990 | Baresel et al. | 313/118 |
| 5,892,201 | A | | 4/1999 | Croucher et al. | |

FOREIGN PATENT DOCUMENTS

| | | | | |
|---|---|---|---|---|
| GB | 1188650 | * | 4/1970 | 219/267 |
| JP | 2-251012 | * | 10/1990 | 219/270 |
| JP | 3064715 | | 9/1999 | |

* cited by examiner

*Primary Examiner*—John A. Jeffery
(74) *Attorney, Agent, or Firm*—Mike W. Crosby; Peter F. Corless; Edwards & Angell, LLP

(57) ABSTRACT

An igniter for use in industrial and domestic gas burning appliances is disclosed. One embodiment of the igniter includes an igniter element disposed on the longitudinal axis of a tubular shield. The shield includes at least one open slot formed therethrough for providing a passageway through which gas and air can flow, thereby forming one or more open spiral patterns in the tubular shield. Another embodiment of the igniter includes an igniter element disposed on the longitudinal axis of a spiral coil. Still another embodiment of the igniter includes an igniter element disposed on the longitudinal axis of a ceramic, cylindrical sleeve. The sleeve includes at least one hole formed therethrough for optimally exposing the igniter element to a gas flow. The tubular shield, the spiral coil, and the ceramic sleeve protect the igniter element from accidental damage or breakage, and allow an optimal flow of gas and air to the igniter element, thereby facilitating subsequent ignition of the gas.

10 Claims, 6 Drawing Sheets

IGNITER SHIELDS

BACKGROUND OF THE INVENTION

1. Field of the Invention

This invention relates generally to igniters for gaseous fuel, and more particularly to igniters that include igniter elements and shields for protecting the igniter elements.

2. Background

Igniters, particularly, non-pilot light igniters, have been used in industrial and domestic gas burning appliances such as gas-fired furnaces, stoves, clothes dryers, and the like.

FIG. 1A shows a conventional igniter 100, which includes an igniter element 106 essentially disposed within an igniter shield 101 (see also FIG. 1B) for protecting the igniter element 106. Typically, the igniter element 106 is a ceramic igniter element, such as that disclosed in U.S. Pat. No. 5,892,201 ("the '201 patent") issued Apr. 6, 1999, to Croucher et al., and assigned to Saint-Gobain Industrial Ceramnics; Inc., Worcester, Mass., USA. That patent discloses inter alia a ceramic igniter element that includes a pair of conductive, end portions coupled to a highly resistive middle portion (also known as a "hot zone"). When the conductive end portions of the ceramic igniter are connected to respective leads and a voltage is applied thereto, the hot zone of the ceramic igniter rises in temperature, thereby radiating sufficient energy for producing stable, high temperatures suitable for igniting the gas.

Similarly, the igniter element 106 includes conductive end portions (not shown) coupled to a hot zone (not shown). Specifically, the conductive end portions of the igniter element 106 are connected to respective leads 110. A portion (not numbered) of the igniter element 106 with the leads 110 connected thereto is normally cemented within a ceramic sleeve (also known as a "block") 108, thereby allowing the remaining portion (not numbered) of the igniter element 106 to extend from one end (not numbered) of the block 108. Further, the leads 110 pass through the length of the block 108 and extend from the opposite end (not numbered) of the block 108.

Accordingly, when a suitable voltage is applied across the leads 110, a current flows from one of the leads 110 to one of the conductive end portions of the igniter element 106; through the hot zone of the igniter element 106, thereby causing the temperature of the hot zone to rise; to the other conductive end portion of the igniter element 106; and, then to the other lead 110.

Because conventional igniter elements may be subject to damage or breakage, the igniter 100 is provided with the shield 101. For example, as shown in FIG. 1B, the conventional shield 101 is typically stamped out from metal sheet stock, which is usually a high temperature metal alloy. Specifically, the shield 101 includes a first portion 102*a* and a second portion 102*b*, with a pair of slots 105 formed between the first and second portions 102*a* and 102*b*.

After the shield 101 is stamped out from the metal sheet stock, the first and second portions 102*a* and 102*b* of the shield 101 are typically formed into substantially tubular sections, as shown in FIG. 1A. The insulative block 108 is then press-fit into the second tubular portion 102*b* of the shield 101, thereby causing the igniter element 106 to be disposed within the first tubular portion 102*a* of the shield 101.

As shown in FIG. 1B, a plurality of randomly spaced holes 104 is typically formed through the first portion 102*a* of the conventional shield 101. Accordingly, when the igniter element 106 is disposed within the first tubular portion 102*a* of the shield, as shown in FIG. 1A, gas and air (not shown) surrounding the igniter 100 can flow through the plurality of holes 104 to the igniter element 106, thereby facilitating subsequent ignition of the gas.

However, it has now been recognized that the conventional igniter 100, as shown in FIG. 1A, can have certain drawbacks. For example, because the process for manufacturing the shield 101, including the steps of setting-up the tooling required for making the shield 101, stamping out the shield 101 from the metal sheet stock, and forming the first and second tubular portions 102*a* and 102*b* of the shield 101, is relatively expensive to implement, the shield 101 substantially increases the cost of the igniter 100.

In addition, in some applications, insufficient amounts of gaseous fuel and air surrounding the igniter 100 flow through the plurality of holes 104 formed in the shield 101 to the igniter element 106, thereby causing the igniter element 106 to fail in successive attempts to ignite the gas. The lack of cooling airflow to the igniter element 106 also frequently causes the igniter 100 to overheat and subsequently burnout prematurely, thereby increasing the cost of using the igniter 100.

It would therefore be desirable to have an igniter including an igniter element and a shield for protecting the igniter element from accidental damage or breakage. Such an igniter would be relatively inexpensive to manufacture and use. It would also be desirable to have an igniter including an igniter element and a shield for protecting an igniter element that has improved ignition characteristics.

SUMMARY OF THE INVENTION

The present invention provides an igniter, including an igniter shield with at least one opening formed therethrough marked by a spiral pattern, for improving ignition characteristics of a shielded igniter element and increasing the lifetime of the igniter. The present invention also provides a simplified process for manufacturing the igniter that is relatively inexpensive to implement.

According to a first embodiment of the present invention, an igniter includes an igniter element adapted for igniting gaseous fuel; and, a tubular shield for protecting the igniter element, the igniter element being disposed along the longitudinal axis of the shield, wherein the shield includes at least one opening therethrough forming an oriented spiral passageway.

According to a second embodiment of the present invention, an igniter includes an igniter element for igniting gas; and, a coil or spring-type element for protecting the igniter element, the igniter element being disposed on the longitudinal axis of the spiral coil.

According to a third embodiment of the present invention, an igniter includes an igniter element for igniting the gas; and a cylindrical, insulative sleeve for protecting the igniter element, the igniter element being axially disposed in the sleeve, wherein the sleeve includes as least one hole formed therethrough for exposing a portion of the igniter element to the gas.

The shields of the present invention protect the igniter element from undesired damage and breakage, and allow an optimal flow of gas and air to the igniter element, thereby facilitating subsequent ignition of the gas. The optimal cooling airflow toward the igniter element also prevents overheating of the igniter element, thereby increasing the useful lifetime of the igniter.

According to a fourth embodiment of the present invention, a method of manufacturing an igniter includes stamping out a shield from metal sheet stock; forming the shield into a substantially tubular section; and, disposing an igniter element on the longitudinal axis of the tubular shield.

Other aspects of the invention are disclosed infra.

DETAILED DESCRIPTION OF THE INVENTION

As indicated above, the invention provides new shield elements for sintered ceramic igniters. The igniter shields of the invention are characterized in several distinct aspects. In a first aspect, igniter shields are provided that have one or more spirally shaped openings along a substantial length of the shield. In a further aspect, spiral shields are provided that are of a coil or spring-like design. In a still further aspect of the invention, igniter shields are monolithically formed within a ceramic block element, with at least one opening therethrough.

Figure 2:
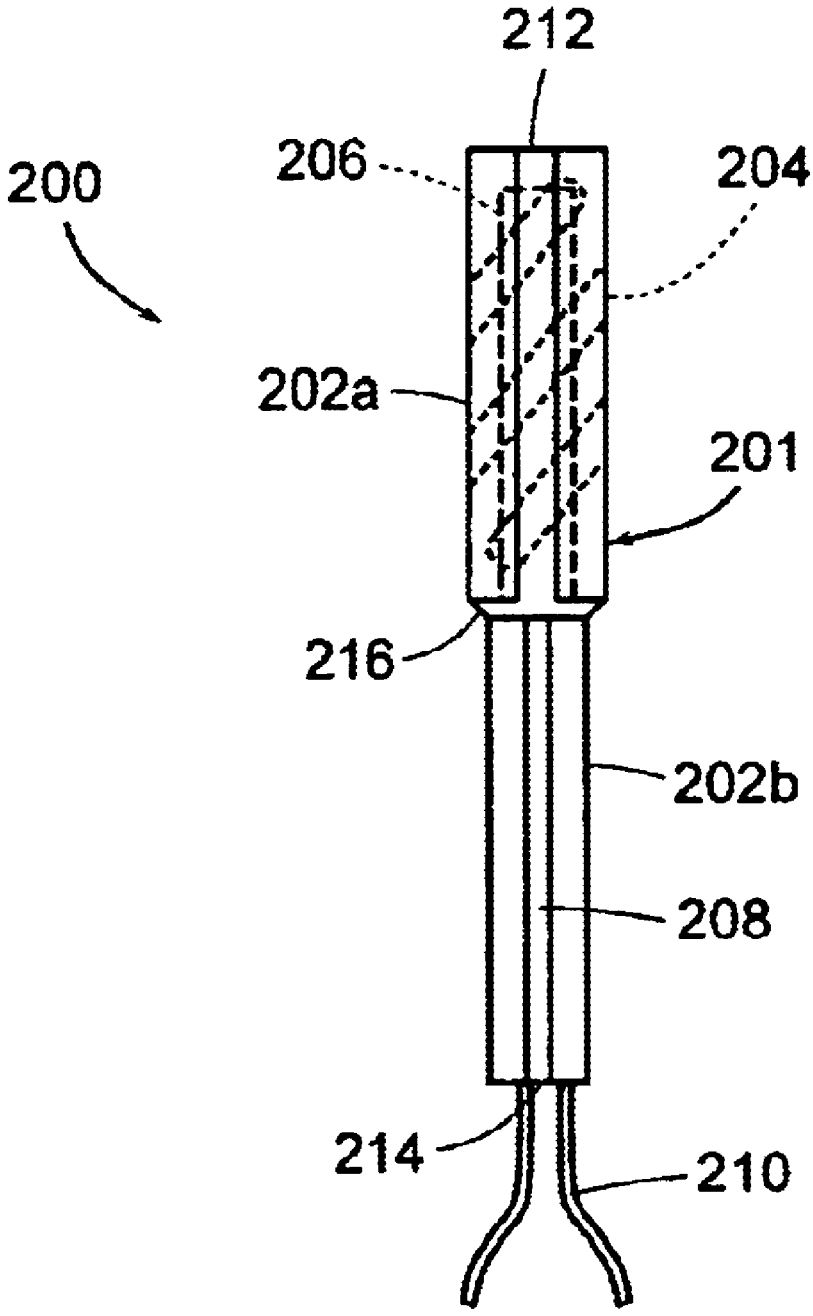
FIG. 2 is a side view of an igniter including a first embodiment of an igniter shield, in accordance with the present invention.

Referring now in detail to the drawings, FIG. 2 shows a side view of an igniter 200, including a first embodiment of an igniter shield 201, in accordance with the present invention. In an illustrative embodiment, the igniter 200 includes an igniter element 206, such as the ceramic igniter element disclosed in U.S. Pat. No. 5,892,201 ("the '201 patent") issued Apr. 6, 1999, to Croucher et al., the specification of which is incorporated herein by reference.

Accordingly, the igniter element 206 typically includes conductive end portions (not shown) coupled to a highly resistive middle portion (not shown), which is also known as a "hot zone." Specifically, the conductive end portions of the igniter element 206 are connected to respective leads 210. A portion (not numbered) of the igniter element 206 with the leads 210 connected thereto is then mounted, e.g., cemented using a suitable adhesive, within a ceramic sleeve (also known as a "block") 208, thereby allowing the remaining portion (not numbered) of the igniter element 206 to extend from one end (not numbered) of the block 208. Further, the leads 210 pass through the length of the block 208 and extend from the opposite end (not numbered) of the block 208.

It should be understood that the igniter element 206 is conventional; and, specific structures used for implementing the igniter element 206 are therefore not critical to the preferred embodiment of the present invention, and may take different forms.

Because the conventional igniter element 206 is frequently subject to accidental damage or breakage, the igniter 200 is provided with the shield 201, which may be made of any suitable material. In this first embodiment of the shield 201 as shown in FIG. 2, the shield 201 is preferably made of a material that not only has sufficient hardness for protecting the igniter element 206 from inadvertent damage or breakage, but is also malleable for easily forming the shield 201 and subsequently incorporating the shield 201 into the igniter 200. For example, the first embodiment of the shield 201 is preferably made of a high temperature metal alloy, e.g., INCONEL™ or KANTHAL™ metal alloy.

Specifically, the shield 201 includes a first tubular portion 202*a*, a second tubular portion 202*b*, and an optional connecting portion 216 for connecting the first and second portions 202*a* and 202*b*. Both the first and second portions 202*a* and 202*b* of the shield 201 have substantially circular cross-sections (see, e.g., corresponding elements 302*a* and 302*b* of FIG. 3C), thereby defining respective diameters.

More specifically, the diameter defined by the substantially circular cross-section of the second tubular portion 202*b* is preferably slightly smaller than the diameter of the insulative block 208. This allows the block 208 to be press-fit into the second tubular portion 202*b*, thereby causing the igniter element 206 to be disposed within the first tubular portion 202*a* of the shield 201, as shown in FIG. 2. Further, the second tubular portion 202*b* preferably includes a relatively narrow, elongated gap 214 for allowing flexion of the second portion 202*b*, as the block 208 is press-fit therein.

Not only does the shield 201 protect the igniter element 206 from accidental damage or breakage, but it also facilitates mounting of the igniter 200 in a target industrial or domestic gas burning appliance (not shown). For example, the second tubular portion 202*b* of the igniter shield. 201, with the block 208 press-fit therein, provides a rigid handle that might be suitably coupled to a mounting structure (not shown) in the gas burning appliance.

It should be noted that the diameter defined by the substantially circular cross-section of the first tubular portion 202*a* is preferably larger than the diameter defined by the cross-section of the second tubular portion 202*b*. This is for providing sufficient clearance between the metallic first portion 202*a* and the igniter element 206, thereby decreasing capacitive coupling therebetween and reducing occurrences of electric arcing. Generally, higher voltage igniter elements 206 require greater clearances between the igniter elements 206 and respective first tubular portions 202*a*. Further, the shield 201 is preferably suitably grounded for providing a degree of electrostatic shielding. The larger diameter of the first tubular portion 202*a* also facilitates the flow of gas and air to the igniter element 206.

Further, like the second tubular portion 202*b*, the first tubular portion preferably includes a relatively narrow, elongated gap 212 for allowing flexion of the first portion 202*a*, thereby enabling the diameter of the first portion 202*a*, and therefore the clearance between the first portion 202*a* and the igniter element 206 disposed therein, to be suitably adjusted in accordance with the voltage characteristics of the igniter element 206.

In the first embodiment of the shield 201, a plurality of slots 204 is formed through the first tubular portion 202*a*, thereby forming open spiral patterns in the first portion 202*a* of the shield 201. Specifically, each slot 204 is a relatively narrow opening or passage diagonally formed through the first tubular portion 202*a*. Further, the diagonal slots 204 are preferably parallel along a substantial width, W (see FIG. 3A), of the first tubular portion 202*a*. As a result, the plurality of slots 204 winds at least a portion of the way around the longitudinal axis (not shown) of the first tubular portion 202*a*, thereby forming the above-mentioned open spiral patterns along a substantial length, L (see FIG. 3A), of the first tubular portion 202*a*.

Accordingly, when the igniter element 206 is disposed within the first tubular portion 202*a*, as shown in FIG. 2, gas and air (not shown) surrounding the igniter 200 flow through the gap 212 and the plurality of slots 204 to the igniter element 206, thereby facilitating subsequent ignition of the gas.

It has been discovered that by providing the igniter shield 201 with the first tubular portion 202*a* having the plurality of slots 204 that at least partially encompasses the igniter element 206 in the open spiral patterns significantly improves the ignition characteristics of the igniter 200.

Further, it is believed that this unexpected result arises, at least in part, as a consequence of the increased diameter of the first tubular portion 202*a* relative to that of the second tubular portion 202*b*; the dimensions of the elongated gap 212 formed by the first tubular portion 202*a*; and, the open spiral patterns formed by the plurality of slots 204, which it is believed causes a vortex of gas and air to form within the shield 201 and around the igniter element 206 that, similar to a venturi tube, increases the flow velocity and decreases the pressure of the gas and air within the shield 201, thereby creating a suction that draws the gas and air surrounding the igniter 200 through the gap 212 and the plurality of slots 204 toward the igniter element 206.

Because the open spiral patterns formed by the plurality of slots 204 cause the gas and air surrounding the igniter 200 to be drawn toward the igniter element 206, it is expected that the igniter 200 would successfully ignite the gas in many applications in which conventional systems fail. It is also expected that the increased airflow toward the igniter element 206 would reduce the occurrence of overheating of the igniter element 206, thereby preventing premature burn-out of the igniter 200.

A preferred method of manufacturing the shielded igniter 200 of the present invention will now be described with reference to FIGS. 3A through 3C. As mentioned above, the igniter element 206 of the shielded igniter 200 is conventional. Accordingly, the first step of the preferred method of manufacturing the shielded igniter 200 includes providing the conventional igniter element 206.

Next, the shield 201 is stamped out from the metal sheet stock, which may be the above-mentioned high temperature metal alloy. Specifically, FIG. 3A shows a shield 301, which corresponds with the stamped out shield 201. The shield 301 includes a first portion 302*a*, a second portion 302*b*, and a pair of slots 305 formed between the first and second portions 302*a* and 302*b*, thereby forming a connecting portion 316.

Further, a plurality of diagonal slots 304 is preferably formed in the first portion 302*a* of the shield 301 when the shield 301 is stamped out from the metal sheet stock. Specifically, the diagonal slots 304 are formed through the first portion 302*a* of the shield 301, each at an angle of about 45° from edges (not numbered) of the stamped out first portion 302*a*, thereby forming the plurality of slots 304 obliquely inclined along the width, W, of the first portion 302*a*. It should be noted that the total number of diagonal slots 304 formed in the first portion 302*a* of the shield 301 is generally dependent upon the actual dimensions of the first portion 302*a*, which in turn is generally dependent upon the length of the igniter element 206 (see FIG. 2). In the preferred embodiment, as many diagonal slots 304 as possible are formed in the first portion 302*a*, while still maintaining the structural integrity of the shield 301.

Specifically, for an igniter element 206 (see FIG. 2) having a typical length of from about 25 mm to about 30 mm, useful actual dimensions of the first portion 302*a* are about 30 mm by about 60 mm. Accordingly, the pitch of the plurality of diagonal slots 304 preferably ranges from about 30° to about 50°, and more preferably from about 40° to about 45°. Further, the width of each diagonal slot 304 preferably ranges from about 1 mm to about 5 mm, and more preferably from about 2 mm to about 4 mm After the shield 301 is stamped out from the metal sheet stock, the first and second portions 302*a* and 302*b* of the shield 301 are then formed into the substantially tubular portions 302*a* and 302*b*, as shown in FIG. 3B. Specifically, the first tubular portion 302*a* is formed for including a gap 312, which allows flexion for subsequently adjusting the diameter of the first tubular portion 302*a*. Similarly, the second tubular portion 302*b* is formed for including a gap 314, which allows flexion for subsequently press-fitting the block 208 (see FIG. 2) into the second tubular portion 302*b*.

More specifically, as the first and second portions 302*a* and 302*b* of the shield 301 are formed into the tubular portions 302*a* and 302*b*, the connecting portion 316 is preferably angled for making the first and second portions 302*a* and 302*b* concentric. For example, FIG. 3C shows a simplified top plan view of the igniter shield 301, including the concentric first and second tubular portions 302*a* and 302*b*. The concentricity of the first and second tubular portions 302*a* and 302*b* facilitates subsequent incorporation of the igniter element 206 (see. FIG. 2) into the shield 301.

Next, the insulative block 208 (see FIG. 2) is press-fit into the second tubular portion 302*b* of the shield 301, thereby causing the igniter element 206 (see FIG. 2) to be axially disposed within the first tubular portion 302*a* of the shield 301 and the leads 210 (see FIG. 2) to extend from a free end (not numbered) of the second tubular portion 302*b*. The manufactured shielded igniter 200 (see FIG. 2) is now ready for mounting in the target industrial or domestic gas burning appliance.

It follows from the foregoing detailed description that the igniter including the igniter element and the first embodiment of the igniter shield of the present invention yields important advantages over conventional igniters. For example, in addition to protecting the igniter element from inadvertent damage or breakage and facilitating the mounting of the igniter in the target gas burning appliance, the igniter of the present invention decreases capacitive coupling between the igniter element and the first embodiment of the igniter shield, thereby reducing occurrences of electric arcing. This is, at least in part, because of the increased diameter of the first tubular portion relative to that of the second tubular portion of the shield.

In addition, the igniter of the present invention significantly enhances the flow of gas and air to the igniter element, thereby facilitating subsequent ignition of the gas, even in many applications in which conventional systems fail. This is, at least in part, because of the increased diameter of the first tubular portion and the dimensions of the elongated gap in the first tubular portion; and, in larger part, because of the open spiral patterns formed by the plurality of slots in the first tubular portion of the first embodiment of the shield. These features also prevent the igniter from overheating and subsequently burning-out prematurely, thereby increasing the useful lifetime of the igniter while decreasing the cost of using the igniter.

Figure 4:
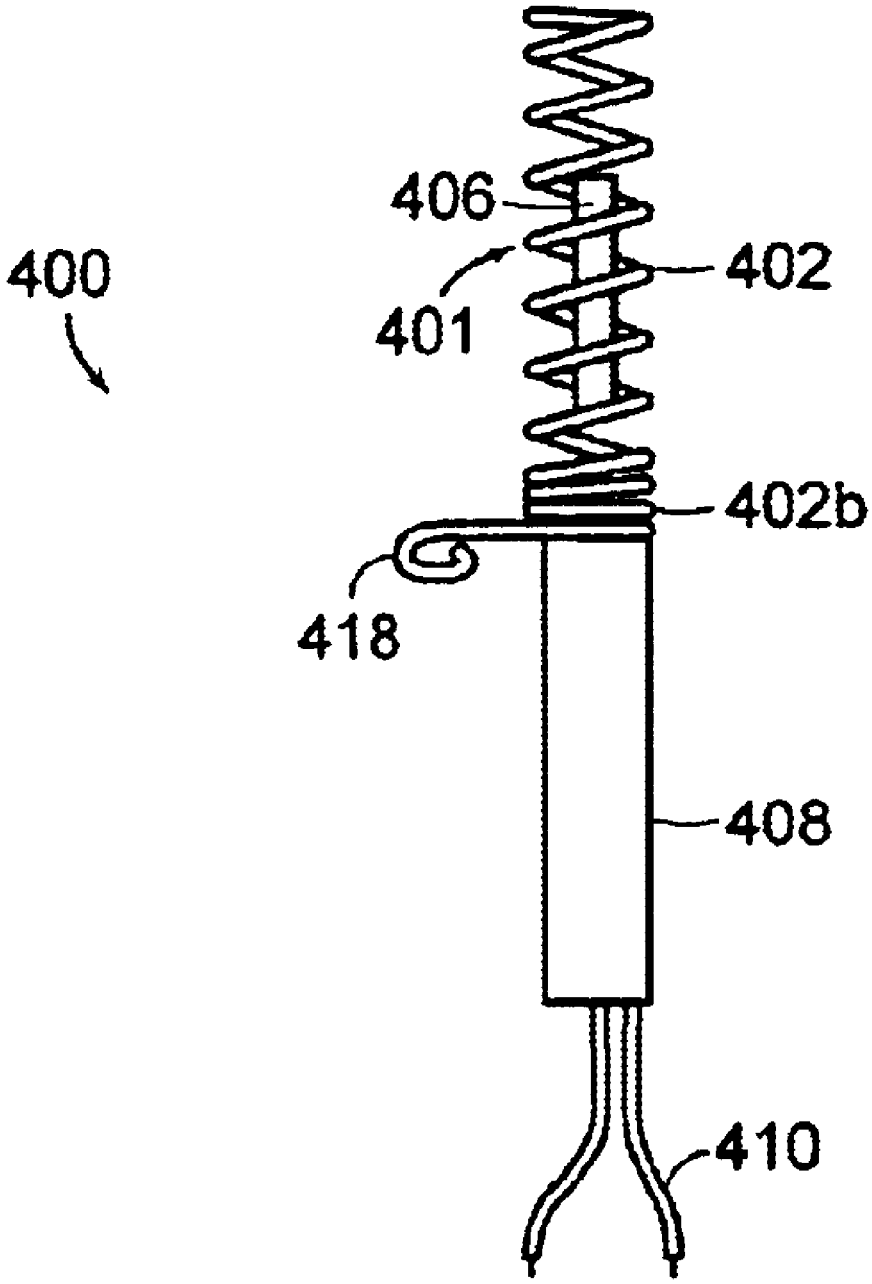
FIG. 4 is a side view of an igniter including a second embodiment of the igniter shield, in accordance with the present invention.

Having described one embodiment, numerous alternative embodiments or variations might be made. For example, FIG. 4 shows a side view of an igniter 400, including a spiral coil 401, which is a second embodiment of the igniter shield for protecting an igniter element, e.g., an igniter element 406, in accordance with the present invention. Specifically, the igniter element 406, a ceramic block 408, and leads 410, correspond with the igniter element 206, the block 208, and the leads 210, respectively, as shown in FIG. 2. However, instead of incorporating a shield such as the shield 201 (see FIG. 2) into the igniter 400, the igniter 400 includes the spiral coil 401.

More specifically, the spiral coil 401 may be made of any suitable material. In one embodiment, the spiral coil 401 is made of a material that not only has sufficient hardness for protecting the igniter element 406 from impacts, but also has sufficient resilience and elasticity for absorbing the shocks of the impacts, thereby protecting the igniter element 406 from inadvertent damage or breakage. In another embodiment, the spiral coil 401 is made of a rigid material. In the illustrative embodiment shown in FIG. 4, the spiral coil 401 is a coiled wire made of a high temperature metal alloy, e.g., INCONEL™ or KANTHAL™ metal alloy.

The spiral coil 401 includes a main portion 402, which is coiled in a helix. The main portion 402 has an inside diameter that provides sufficient clearance between the metallic coil 401 and the igniter element 406, thereby decreasing capacitive coupling therebetween and reducing occurrences of electric arcing. The spiral coil 401 is also preferably grounded for providing a degree of electrostatic shielding. For example, the spiral coil 401 may be suitably grounded using a mounting loop 418 formed thereon.

For example, the coiled wire forming the helical portion 402 of the coil 401 has a diameter and a pitch, which are selected for providing a desired level of resilience and elasticity and, more significantly, for allowing optimal flow of gas and air (not shown) surrounding the igniter 400 to the igniter element 406. In the preferred embodiment, the coiled wire forming the main portion 402 of the coil 401 has a diameter that preferably ranges from about 5 mm to about 15 mm, and more preferably from about 7 mm to about 9 mm; and, a pitch that preferably ranges from 5° to about 50°, and more preferably from about 10° to about 30°.

The spiral coil 401 also includes a base portion 402*b*, which is tightly coiled in a helix with a substantially circular cross-section (not shown), thereby defining a diameter. Specifically, the diameter defined by the substantially circular cross-section of the base portion 402*b* is preferably slightly smaller than the diameter of the insulative block 408. This allows the block 408 to be, e.g., securely threaded into the base portion 402*b*, thereby causing the igniter element 406 to be axially disposed within the main portion 402 of the coil 401.

Because the above-described method of manufacturing the shielded igniter 200 (see FIG. 2) generally includes the additional step of setting-up the tooling required for making the shield 201, that manufacturing method can sometimes be relatively expensive. Because no tooling is required for making the spiral coil 401, the cost of manufacturing the igniter 400 is significantly less than that of manufacturing the igniter 200. Advantageously, this reduces the overall cost of the igniter 400.

Figure 5A:
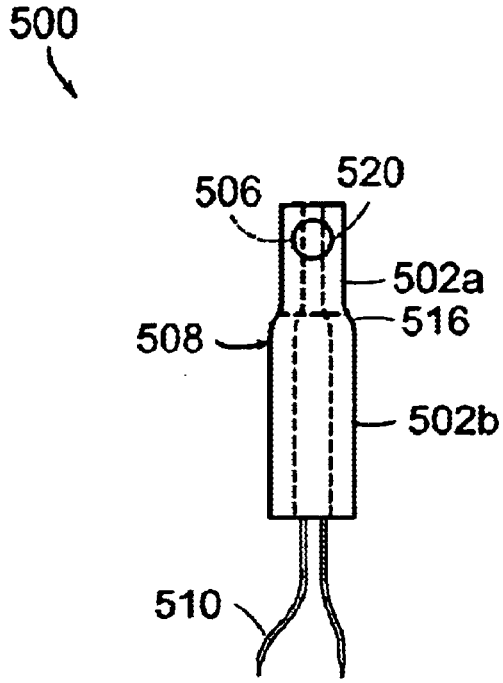
FIG. 5A is a side view of an igniter including a third embodiment of the igniter shield, in accordance with the present invention.

In addition, FIG. 5A shows a side view of an igniter 500, including a modified ceramic block 508, which is a third embodiment of the igniter shield for protecting an igniter element, e.g., an igniter element 506, in accordance with the present invention. Specifically, the igniter element 506 and leads 510 correspond with the igniter element 206 and the leads 210, respectively, as shown in FIG. 2. However, instead of incorporating a shield such as the shield 201 (see FIG. 2) into the igniter 500, the igniter 500 includes the modified monolithic block 508.

Figure 5B:
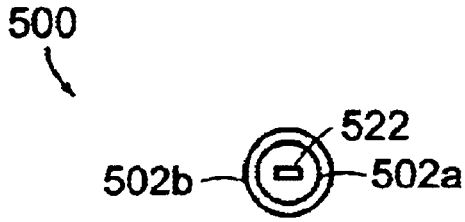
FIG. 5B is a top plan view of the igniter of FIG. 5A.

More specifically, the block 508 may be made of any suitable insulative material. Like the blocks 208 (see FIG. 2) and 408 (see FIG. 4), the block 508 is preferably made of a ceramic material. Further, the block 508 includes a first cylindrical portion 502*a*, a second cylindrical portion 502*b*, and a shoulder portion 516 between the first and second cylindrical portions 502*a* and 502*b*, which have substantially circular cross-sections (not shown) that define respective diameters. As suggested in FIGS. 5A and 5B, the diameter of the first cylindrical portion 502*a* is preferably smaller than the diameter of the second cylindrical portion 502*b*.

Further, FIG. 5A shows a substantially circular hole 520 formed through the first cylindrical portion 502*a*, thereby exposing portions (not numbered) of the hot zone on opposing sides (not shown) of the igniter element 506, a portion of which is disposed in at least one slot, e.g., a slot 522 formed through a closed end (not numbered) of the first portion 502*a* (see FIG. 5B), thereby fixedly disposing the igniter element 506 along the longitudinal axis (not shown) of the block 508.

It should be noted that dimensions of the block 508 are generally dependent upon the length of the igniter element 506. In an illustrative embodiment, the first portion 502*a* has a length of about 13 mm and a diameter of about 8 mm; and, the second portion 502*b* has a length of about 23 mm and a diameter of about 9 mm. Further, the hole 520 has a diameter that preferably ranges from about 3 mm to about 6 mm.

A method of manufacturing the igniter 500 includes the step of mounting the igniter element 506 with the leads 510 operatively connected thereto within the ceramic block 508. For example, the igniter element 506 may be cemented using a suitable adhesive within the block 508. Because the modified block 508 includes the first cylindrical portion 502*a* that encompasses and protects the igniter element 506, the block 508 itself may be used as a fixture for the mounting step. Advantageously, the block 508 protects the igniter element 506 from accidental damage or breakage not only during operation in a target gas burning appliance (not shown), but also during manufacture of the igniter 500.

Further, the igniter 500 is particularly useful when the target gas burning appliance is a stove top appliance (not shown). This is because the ceramic block 508 is inherently moisture-proof, which is an important feature of igniters used in cooking appliances. For example, the first cylindrical portion 502*a* with the smaller diameter may be operatively inserted into a gas burner (not shown) of the stove top appliance up to the shoulder portion 516, thereby exposing the igniter element 506 to a flow of gas (not shown) via the opposing holes 520 for subsequent ignition of the gas. It should be noted that the block 508 not only protects the igniter element 506 from inadvertent damage or breakage, but also allows optimal exposure of the igniter element 506 to the gas flow via the holes 520.

In addition, as to the embodiment of the shielded igniter shown in FIG. 2, it was described that each slot formed in the first tubular portion of the shield is at an angle of about 45°. However, this was merely an illustrative example. The slots might alternatively be formed at any angle between 0° and 90° from an edge of the stamped out first tubular portion. Further, the slots alternatively can be formed in parallel with the igniter element disposed in the first tubular portion of the shield or orthogonal thereto. Still further, neighboring slots might be formed at the same angle or alternatively at different angles, thereby forming different spiral passageway orientations through the first tubular portion of the shield.

In addition, it was described that the first embodiment of the shield includes the plurality of slots formed through the first tubular portion, thereby forming oriented spiral passageways through the first portion of the shield. It was also described that each slot formed through the first tubular portion is a diagonal, relatively narrow opening or passage. However, this was also merely an illustrative example. Each oriented spiral passageway through the shield might alternatively include a single opening or a plurality of openings.

Figure 3A:
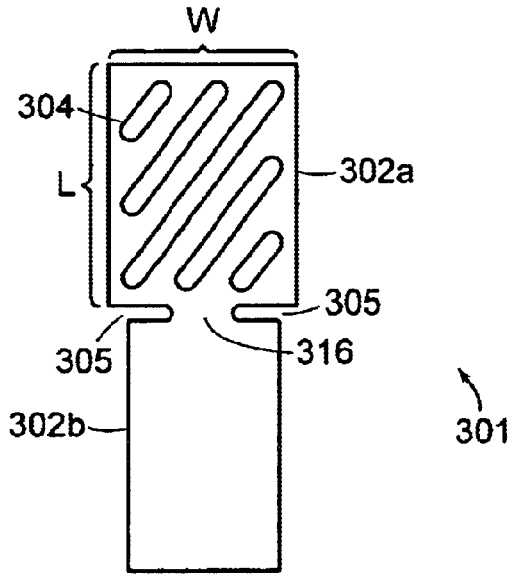
FIG. 3A is a plan view of the igniter shield shown in FIG. 2, stamped out from metal sheet stock.
Figure 6:
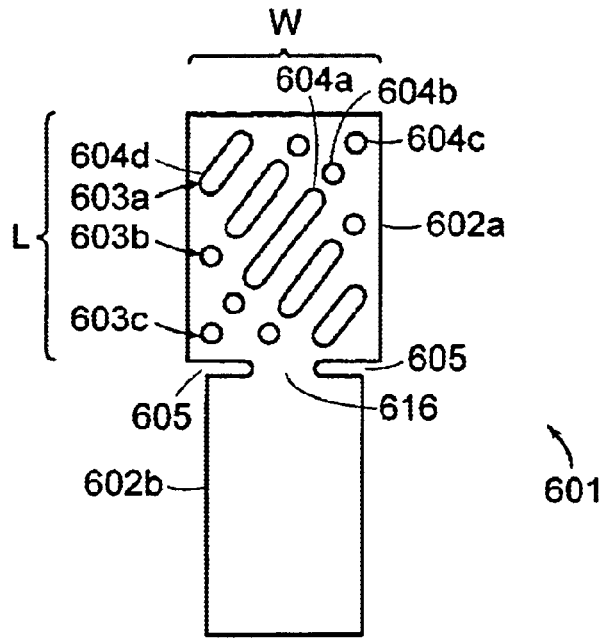
FIG. 6 is a plan view of an alternative embodiment of the igniter shield shown in FIG. 3A.

For example, FIG. 6 shows a stamped out igniter shield 601, which is an alternative embodiment of the igniter shield shown in FIG. 3A. The shield 601 includes a first portion 602*a*, a second portion 602*b*, and a pair of slots 605 formed between the first and second portions 602*a* and 602*b* for forming a connecting portion 616. However, instead of including a plurality of diagonal slots formed in the first portion of the shield as shown in FIG. 3A, the shield 601 includes a plurality of oriented spiral passageways, e.g., passageways 603*a*, 603*b*, and 603*c*, formed in the first portion 602*a* of the shield 601.

Specifically, each of the plurality of oriented spiral passageways formed in the first portion 602*a* of the shield 601 may include a single opening, e.g., a slot 604*d* included in the passageway 603*a*; or, a plurality of openings, e.g., a slot 604*a* and holes 604*b* and 604*c* included in the passageway 603*c*. Further, the opening or openings included in respective oriented spiral passageways formed in the first portion 602*a* of the shield 601 may be slots, holes, or any other geometrical shape so long as the openings and their nearest neighbor openings, if any, are arranged in the aforesaid spiral passageway orientations.

More specifically, the passageway 603*c* includes the hole 604*b*, which has two nearest neighbor openings, i.e., the slot 604*a* and the hole 604*c*. Further, the slot 604*a* and the holes 604*b* and 604*c* are arranged in the first portion 602*a* of the shield 601 so as to form a portion of the oriented spiral passageway 603*c*. As a result, when the first and second portions 602*a* and 602*b* are subsequently formed into corresponding substantially tubular portions (not shown) of the shield 601, the passageways 603*a*, 603*b*, and 603*c* can at least partially encompass an igniter element (not shown) axially disposed within the first tubular portion. By specifying that shield opening has a nearest neighbor opening, it is meant the opening has an adjacent opening as exemplified in FIG. 6, such as by openings 604*a*, 604*b* and 604*c*, as well as in FIG. 7, such as by openings 704*a*, 704*b* and 704*c*.

Figure 7:
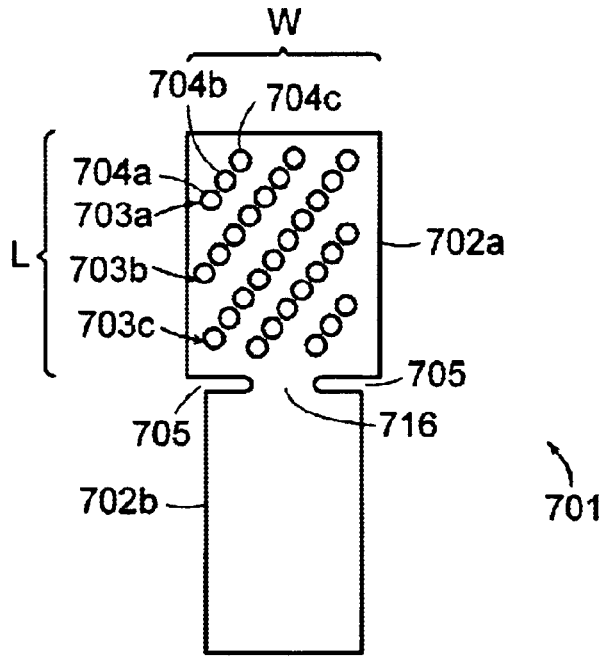
FIG. 7 is a plan view of an alternative embodiment of the igniter shield shown in FIG. 6.

Further, FIG. 7 shows a stamped out igniter shield 701, which is an alternative embodiment of the stamped out igniter shield shown in FIG. 6. The shield 701 also includes a first portion 702*a*, a second portion 702*b*, and a pair of slots 705 formed between the first and second portions 702*a* and 702*b* for forming a connecting portion 716. However, instead of including the plurality of passageways formed in the first portion of the shield as shown in FIG. 6, the shield 701 includes a plurality of oriented spiral passageways, e.g., passageways 703*a*, 703*b*, and 703*c*, formed in the first portion 702*a* of the shield 701.

Specifically, each of the plurality of oriented spiral passageways formed in the first portion 702*a* of the shield 701 includes at least one opening, e.g., holes 704*a*, 704*b*, and 704*c*, included in the passageway 703*a*. Further, the opening or openings included in respective oriented spiral passageways formed in the first portion 702*a* of the shield 701 have the same geometrical shape, which may be a slot, a hole, or any other geometrical shape so long as the openings and their nearest neighbor openings, if any, are arranged in the aforesaid spiral passageway orientations.

More specifically, the passageway 703*a* includes the hole 704*b*, which has two nearest neighbor openings, i.e., the hole 704*a* and the hole 704*c*. Further, the holes 704*a*, 704*b*, and 704*c* are arranged in the first portion 702*a* of the shield 701 so as to form the oriented spiral passageway 703*a*. As a result, when the first and second portions 702*a* and 702*b* are subsequently formed into corresponding substantially tubular portions (not shown) of the shield 701, the passageways 703*a*, 703*b*, and 703*c* can at least partially encompass an igniter element (not shown) axially disposed within the first tubular portion.

The following non-limiting example is illustrative of the invention. All documents mentioned herein are incorporated herein by reference.

EXAMPLE 1

Figure 1A:
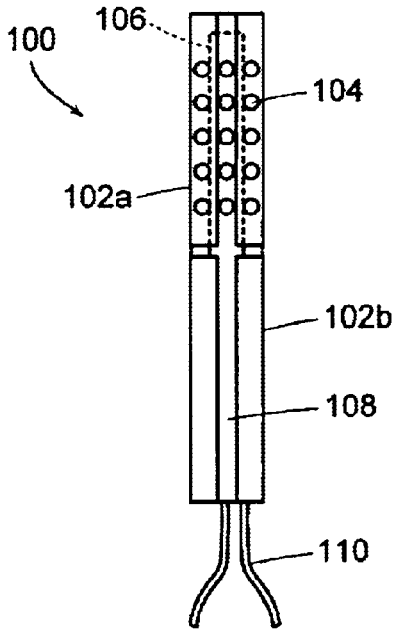
FIG. 1A PRIOR ART
FIG. 1A is a side view of a conventional igniter including a conventional igniter shield.
Figure 1B:
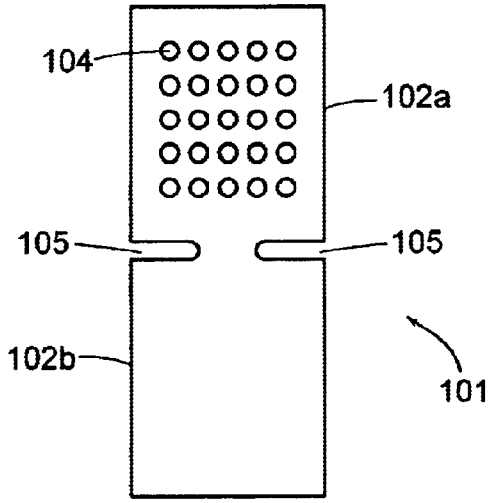
FIG. 1B PRIOR ART
FIG. 1B is a plan view of the conventional igniter shield shown in FIG. 1A, stamped out from metal sheet stock.

A commercially available ceramic igniter housed in a shield corresponding to the shield depicted in FIG. 1A of the drawings failed to ignite a high velocity gas/air mixture in a large, non-residential hot water system.

Figure 3B:
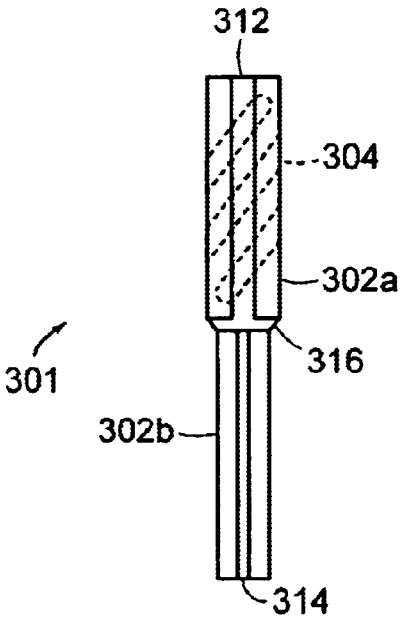
FIG. 3B is a side view of the igniter shield of FIG. 3A, formed into a pair of tubular portions.
Figure 3C:
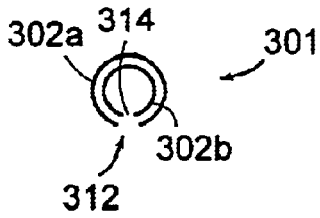
FIG. 3C is a simplified top plan view of the igniter shield of FIG. 3B.

In that same hot water heater system, the same ceramic igniter housed in a shield having spiral openings and corresponding to FIG. 3B readily ignited the high velocity gas/air fuel mixture.

The present invention has been described in detail including the preferred embodiments thereof. However, it should be appreciated that those skilled in the art, upon consideration of the present disclosure, may make modifications and/or improvements on this invention and still be within the scope and spirit of this invention as set forth in the following claims.

What is claimed is:

1. An igniter comprising:

a ceramic igniter having a conductive portion and adapted for igniting gaseous fuel, the conductive portion i) coupled to a resistive hot zone of the igniter, and ii) connected to an electrical lead; and a tubular shield for protecting the igniter element, the igniter element being disposed along the longitudinal axis of the shield, wherein the shield includes a plurality of openings therethrough, each opening forming an oriented spiral passageway.

2. The igniter of claim 1 wherein the plurality of openings are each a spiral slot.

3. The igniter of claim 1 wherein each of the openings has a nearest neighbor opening, and the nearest neighbor of at least one of the openings is another of the openings in the same spiral passageway orientation.

4. The igniter of claim 3 wherein the nearest neighbor of each of the openings is another of the openings in the same spiral passageway orientation.

5. The igniter of claim 1 wherein the plurality of openings are disposed along a substantial length of the shield.

6. The igniter of claim 1, wherein the tubular shield includes a first tubular portion and a second tubular portion coaxially connected at respective ends, the openings being formed through the first tubular portion, the igniter element being axially disposed in the first tubular portion.

7. The igniter of claim 6 wherein the first and second tubular portions have respective substantially circular cross-sections, each cross-section defining a respective diameter, the diameter of the first tubular portion being larger than the diameter of the second tubular portion.

8. The igniter of claim 6 wherein an end of the igniter element is mounted in an insulative sleeve, thereby coaxially mounting the igniter element to the insulative sleeve, and wherein the insulative sleeve is fixedly disposed in the second tubular portion of the shield.

9. The igniter of claim 6 wherein the first tubular portion includes a gap formed therethrough, the gap extending along the length of the first tubular portion.

10. An igniter comprising:

a sintered ceramic igniter element having a conductive portion i) coupled to a resistive hot zone of the igniter, and ii) connected to an electrical lead; and a tubular shield for protecting the igniter element, the igniter element being disposed along the longitudinal axis of the shield, wherein the shield includes a plurality of openings therethrough, each opening forming an oriented spiral passageway.

* * * * *